US008385772B2

(12) United States Patent
Yoon et al.

(10) Patent No.: US 8,385,772 B2
(45) Date of Patent: Feb. 26, 2013

(54) DETACHABLE TONER CARTRIDGE AND IMAGE FORMING APPARATUS INCLUDING THE SAME

(75) Inventors: Young-min Yoon, Yongin-si (KR); Se-il Kwon, Seoul (KR); Young-jo Kwon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 395 days.

(21) Appl. No.: 12/695,298

(22) Filed: Jan. 28, 2010

(65) Prior Publication Data

US 2011/0052266 A1 Mar. 3, 2011

(30) Foreign Application Priority Data

Aug. 28, 2009 (KR) ..... 10-2009-0080720

(51) Int. Cl.
*G03G 15/08* (2006.01)

(52) U.S. Cl. ..... 399/103; 399/106

(58) Field of Classification Search ..... 399/103, 399/106, 258
See application file for complete search history.

(56) References Cited

U.S. PATENT DOCUMENTS 7,116,931 B2 * 10/2006 Yamada et al. ..... 399/262
7,447,470 B2 * 11/2008 Lee ..... 399/262
7,801,468 B2 * 9/2010 Shimomura ..... 399/260

* cited by examiner

*Primary Examiner* — David Gray
*Assistant Examiner* — Gregory H Curran
(74) *Attorney, Agent, or Firm* — Stanzione & Kim, LLP

(57) ABSTRACT

An image forming apparatus includes a toner cartridge that has an inner shutter and an outer shutter and is attached to and detached from a main body through a door disposed on a main body. The outer shutter moves to a position in which toner is allowed to be discharged through a toner outlet of the toner cartridge when the toner cartridge is loaded into the main body, and the inner shutter moves to an open position in which the toner outlet is opened by being interlocked in a closing operation of the door after the toner cartridge is loaded into the main body.

27 Claims, 8 Drawing Sheets

DETACHABLE TONER CARTRIDGE AND IMAGE FORMING APPARATUS INCLUDING THE SAME

CROSS-REFERENCE TO RELATED APPLICATIONS

This application claims priority under 35 U.S.C. 119 from Korean Patent Application No. 10-2009-0080720, filed on Aug. 28, 2009, in the Korean Intellectual Property Office, the disclosure of which is incorporated herein in its entirety by reference.

BACKGROUND

1. Field of the Invention

The present general inventive concept relates to a detachable toner cartridge including a shutter to close or open a toner outlet, and an electrophotographic image forming apparatus including the detachable toner cartridge.

2. Description of the Related Art

An electrophotographic image forming apparatus prints an image on a recording medium by irradiating light modulated according to image information onto a photoconductor in order to form an electrostatic latent image on a surface of the photoconductor, supplying toner to the electrostatic latent image in order to develop the electrostatic latent image into a visible toner image, and transferring and fixing the visible toner image onto the recording medium.

The electrophotographic image forming apparatus includes a process cartridge developing a visible toner image on the photoconductor, and a toner cartridge containing toner that is to be supplied to the process cartridge. The toner cartridge may be attached to and detached from the electrophotographic image forming apparatus. When the toner contained in the toner cartridge is used up, the toner cartridge is replaced with a new toner cartridge.

SUMMARY

The present general inventive concept provides a detachable toner cartridge that can prevent toner from leaking through a toner outlet, and an electrophotographic image forming apparatus including the detachable toner cartridge.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including; a main body that includes a door capable of opening and closing, a process cartridge that is loaded into the main body and includes a toner inlet, and a toner cartridge that contains toner to be supplied to the process cartridge, is attached to and detached from the main body through the door, and includes a toner outlet connected to the toner inlet, an inner shutter having an opening and being capable of moving to an open position in which the opening is in communication with the toner outlet and a closed position in which the toner outlet is closed, and an outer shutter that is disposed outside the inner shutter and is capable of moving to a first position, in which the toner is not allowed to be discharged, and a second position, in which the toner is allowed to be discharged through the opening, wherein the outer shutter moves to the second position when the toner cartridge is loaded into the main body, and the inner shutter moves from the closed position to the open position by being interlocked in a closing operation of the door after the toner cartridge is loaded into the main body.

The image forming apparatus may further include a guide portion disposed in the main body and moving the outer shutter to the second position by interfering with the outer shutter when the toner cartridge is loaded into the main body.

The image forming apparatus may further include an inlet shutter disposed on the process cartridge and opening and closing the toner inlet, wherein the inner shutter moves the inlet shutter to a position in which the toner inlet is opened when the inner shutter moves to the open position.

The image forming apparatus may further include a pivot arm that pivots in an opening and closing operation of the door to move the inner shutter to the open position.

The image forming apparatus may further include: a pinion that is connected to the door with a plurality of links and rotates in the opening and closing operation of the door; and a rack that pivots the pivot arm by being engaged with the pinion and slides.

The image forming apparatus may further include first through third elastic members applying elastic forces to the outer shutter, the inner shutter, and the inlet shutter so that the outer shutter, the inner shutter, and the inlet shutter are located at the closed position, the first position, and a position in which the toner inlet is closed, respectively.

The image forming apparatus may further include a locking member that moves to a locking position in which the inner shutter is locked to the closed position when the outer shutter is located at the first position, and an unlocking position in which the inner shutter is allowed to move when the outer shutter is located at the second position. The image forming apparatus may further include a fourth elastic member applying an elastic force to the locking member in a direction in which the locking member is located at the locking position, wherein when the outer shutter moves to the second position, the locking member interferes with the outer shutter so as to move to the unlocking position.

The foregoing and/or other aspects and utilities of the present general inventive concept may also be achieved by providing a toner cartridge to contain toner to be supplied to a process cartridge and attached to and detached from a main body through a door that is disposed on the main body and is capable of opening and closing, the toner cartridge including a toner outlet through which the toner is discharged, an inner shutter that has an opening and is capable of moving to an open position in which the opening is in communication with the toner outlet and a closed position in which the toner outlet is closed, and an outer shutter that is disposed outside the inner shutter, and is capable of moving to a first position, in which the toner is not allowed to be discharged, and a second position, in which the toner is allowed to be discharged through the opening, wherein the outer shutter moves to the second position when the toner cartridge is loaded into the main body, and the inner shutter moves from the closed position to the open position by being interlocked in a closing operation of the door after the toner cartridge is loaded into the main body.

The toner cartridge may further include first and second elastic members applying elastic forces to the outer shutter and the inner shutter so that the outer shutter and the inner shutter are located at the closed position and the first position, respectively.

The toner cartridge may further include a locking member that comprises a locking position in which the inner shutter is locked in the closed position when the outer shutter is located at the first position, and an unlocking position in which the inner shutter is allowed to move when the outer shutter is located at the second position. The toner cartridge may further include a fourth elastic member applying an elastic force to the locking member in a direction in which the locking member is located at the closed position, wherein when the outer shutter moves to the second position, the locking member interferes with the outer shutter so as to move to the unlocking position.

The foregoing and/or other aspects and utilities of the present general inventive concept may also be achieved by providing a toner cartridge usable with an image forming apparatus, including a housing to contain toner and having a toner outlet to discharge the toner, an inner shutter disposed to move between an opening position to open the toner outlet and a closed position to close the toner outlet, and an outer shutter disposed to move between a first position to prevent the inner shutter from being exposed to an outside of the housing and a second position to expose the inner shutter to the outside of the housing, wherein the toner outlet communicates with the outside when the outer shutter is in the second position and then the inner shutter is in the opening position.

The inner shutter may include a plate and an opening formed therein, and the plate moves to the opening position to dispose the opening to correspond to the toner outlet.

The plate of the inner shutter may include a non-opening portion to define the opening, and the non-opening portion is disposed in the toner outlet in the closing position of the inner shutter.

The inner shutter may protrude from the housing in the opening position.

The inner shutter may move from the closed position to the opening position in a direction when the outer shutter moves from the first position to the second position in another direction opposite to the direction.

The toner cartridge may further include a guide plate disposed between the inner shutter and the outer shutter to guide the inner shutter and the outer shutter with respect to the housing.

The inner shutter and the outer shutter may be disposed in a direction, and the inner shutter and the outer shutter have different lengths in the direction.

The opening of the inner shutter may not be exposed to the toner when the inner shutter is disposed in the closing position.

The foregoing and/or other aspects and utilities of the present general inventive concept may also be achieved by providing an image forming apparatus including a main body having a door and a guide portion, and a toner cartridge to be installed in the main body through the door, and having a housing to contain toner and having a toner outlet to discharge the toner; an inner shutter disposed to move between an opening position to open the toner outlet and a closed position to close the toner outlet, according to a movement of the door, and an outer shutter disposed to move between a first position to prevent the inner shutter from being exposed to an outside of the housing and a second position to expose the inner shutter to the outside of the housing, according to a guiding operation of the guide portion, wherein the toner outlet communicates with the outside when the outer shutter is in the second position and then the inner shutter is in the opening position.

The image forming apparatus may further include a processing unit disposed in the main body, and having an toner inlet and an inlet shutter disposed to open and close the toner inlet, and the toner inlet may move to open the toner inlet to communicate with the toner outlet of the toner cartridge according to a movement of the inner shutter.

The inlet shutter of the processing unit may be disposed at a portion where the outer shutter has been disposed in the first position.

The inlet shutter of the processing unit may prevent the inner shutter of the toner cartridge from being exposed to the outside when the outer shutter is disposed in the second position to expose the inner shutter.

The outer shutter of the toner cartridge may be disposed at a location in the first position, and the inlet shutter of the inlet shutter of the processing unit is disposed at the location to close the toner inlet.

The inner shutter, the outer shutter, and the inlet shutter may have different lengths in a direction of a movement of one of the inner shutter, the outer shutter, and the inlet shutter.

The inner shutter and the outer shutter may have different lengths in a direction of a movement of one of the inner shutter and the outer shutter.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1:
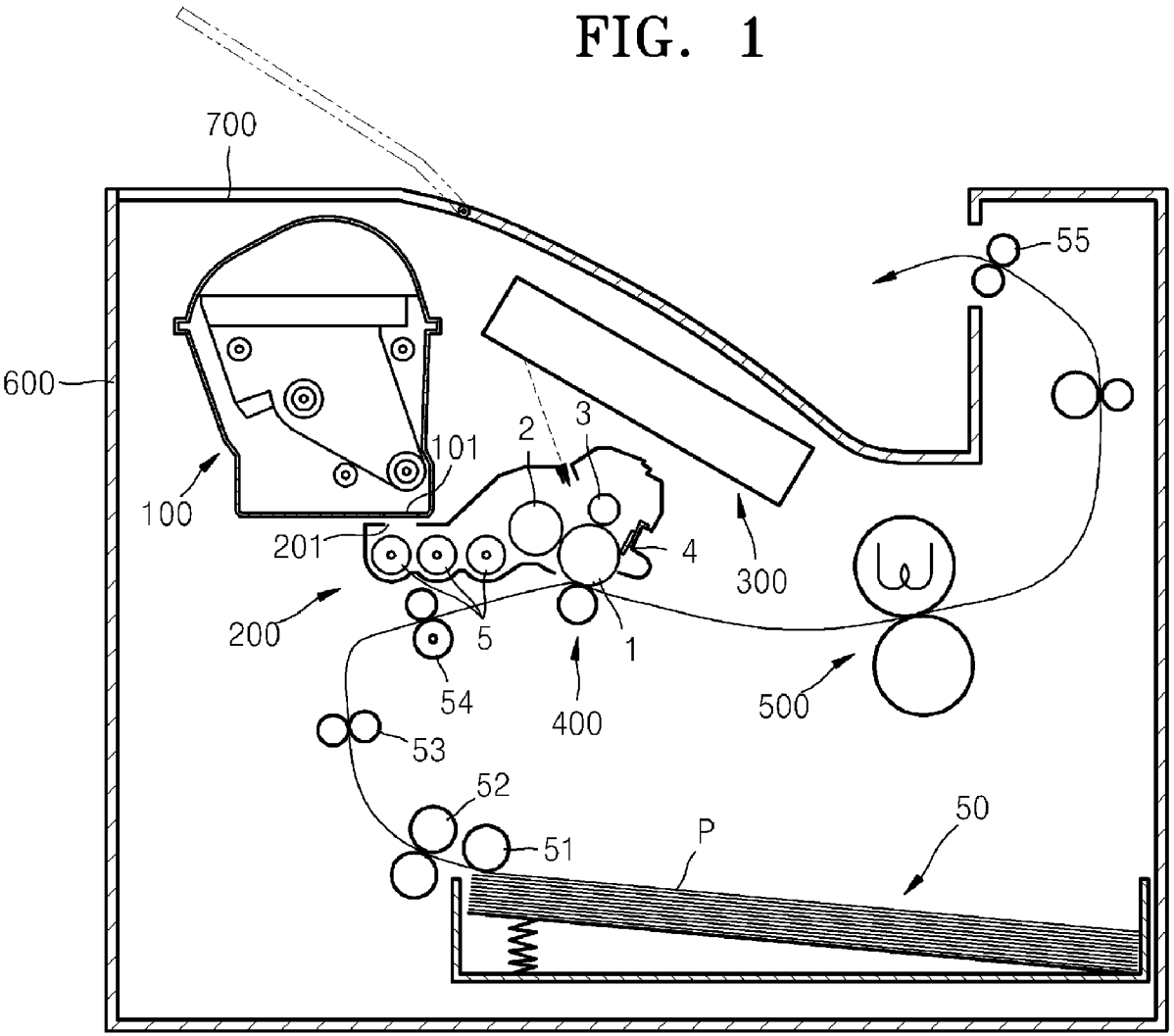
FIG. 1 illustrates an electrophotographic image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates an electrophotographic image forming apparatus according to an embodiment of the present general inventive concept. Referring to FIG. 1, the electrophotographic image forming apparatus includes a toner cartridge 100, a process cartridge 200, an optical scanner 300, a transfer unit 400, and a fixing unit 500. Toner to be supplied to the process cartridge 200 is contained in the toner cartridge 100. The toner cartridge 100 includes a toner outlet 101, and the process cartridge 200 includes a toner inlet 201. The toner cartridge 100 is loaded into a main body 600 of the electrophotographic image forming apparatus through a door 700. The toner outlet 101 is in communication with the toner inlet 201.

A photoconductive drum 1 is formed by laminating a photoconductive layer around an outer circumferential surface of a cylindrical metal pipe. A charging roller 3 is in contact with the photoconductive drum 1. When a charging bias voltage of a power source (not illustrated) is applied to the charging roller 3, a surface of the photoconductive drum 1 is charged to a uniform potential. A corona charger may be used instead of the charging roller 3. A developing roller 2 supplies the toner contained in the process cartridge 200 to the surface of the photoconductive drum 1 in order to develop an electrostatic latent image on the surface of the photoconductive drum 1. If a contact developing method is used, the developing roller 2 and the photoconductive roller 1 are brought into contact with each other to form a development nip. The developing roller 2 may be formed by laminating an elastic layer (not shown) around an outer circumferential surface of a conductive metal core (not shown). When a developing bias voltage of the power source is applied to the developing roller 2, the toner is moved from the process cartridge 200 via the development nip to the electrostatic latent image formed on the surface of the photoconductive drum 1 and attached to the electrostatic latent image. If a non-contact developing method is used, a surface of the developing roller 2 and the surface of the photoconductive drum 1 are spaced apart from each other by a development gap of hundreds of microns. The process cartridge 200 may further include a regulating member (not illustrated) to regulate the amount of toner, which is attached to the surface of the developing roller 3, supplied to the development nip or the development gap. Reference numeral 4 denotes a cleaning member for removing toner and impurities left on the surface of the photoconductive drum 1 before the photoconductive drum 1 is charged. A transport member 5 supplies the toner received from the toner cartridge 100 to the developing roller 2.

The optical scanner 300 scans light modulated according to image information onto the photoconductive drum 1 that has been charged to a uniform potential. For example, the optical scanner 300 may be a laser scanning unit (LSU) that scans light emitted from a laser diode onto the photoconductive drum 1 by deflecting the light in a main scanning direction using a polygon mirror.

The transfer unit 400 may include a transfer roller 4 that is arranged to face the surface of the photoconductive drum 1 and form a transfer nip. A transfer bias voltage of the power source is applied to the transfer roller 4 so as to transfer a toner image developed on the surface of the photoconductive drum 1 to a recording medium P. A corona transfer unit may be used instead of the transfer roller 400.

A method of forming an image using the electrophotographic image forming apparatus configured as described above will now be explained briefly. When a charging bias voltage is applied to the charging roller 3, the photoconductive drum 1 is charged to a uniform potential. The optical scanner 300 scans light modulated in response to image information to the photoconductive drum 1 to form an electrostatic latent image on the surface of the photoconductive drum 1. Toner supplied from the toner cartridge 100 to the process cartridge 200 is attached to the surface of the developing roller 2. The toner is conveyed to a development nip or a development gap as the developing roller 2 rotates. When a developing bias voltage is applied to the developing roller 2, the toner is moved and attached to the electrostatic latent image to form a visible toner image on the surface of the photoconductive drum 1. The recording medium P picked up from a stacking unit 50 by a pick-up roller 51 is transported to a transfer nip between the transfer roller 4 and the photoconductive drum 1 by transport rollers 52, 53, and 54. When a transfer bias voltage is applied to the transfer roller 400, the visible toner image formed on the photoconductive drum 1 is transferred to the recording medium P due to electrostatic attraction. The visible toner image transferred to a surface of the recording medium P by the transfer roller 4 remains adhering to the surface of the recording medium P due to electrostatic attraction. The visible toner image transferred to the recording medium P is fixed to the recording medium P via heat and pressure applied by a fixing unit 500, thereby completing printing of an image corresponding to the image information. The recording medium P is discharged by a discharge roller 55. Toner remaining on the surface of the photoconductive drum 1 without being transferred to the recording medium P is removed by the cleaning member 4.

The toner cartridge 100 and the process cartridge 200 are expendable (or consumable) elements and are individually loaded into the main body 600. During loading, if the toner outlet 101 or the toner inlet 201 is opened, the toner may leak.

Figure 2:
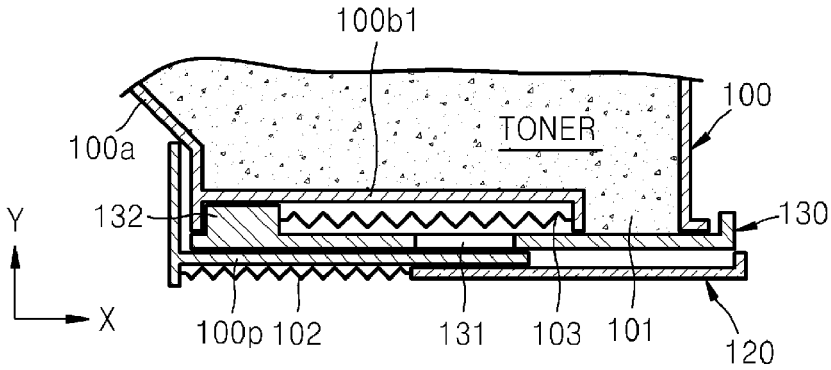
FIG. 2 is a cross-sectional view illustrating a toner cartridge including an inner shutter and an outer shutter, according to an embodiment of the present general inventive concept.
Figure 3:
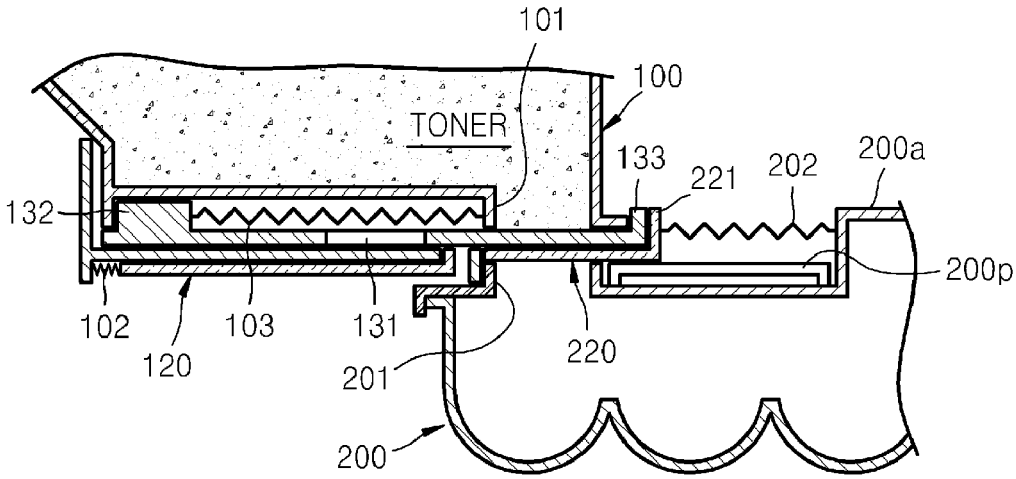
FIG. 3 is a cross-sectional view illustrating a state where the outer shutter of the toner cartridge of FIG. 2 is opened.
Figure 4:
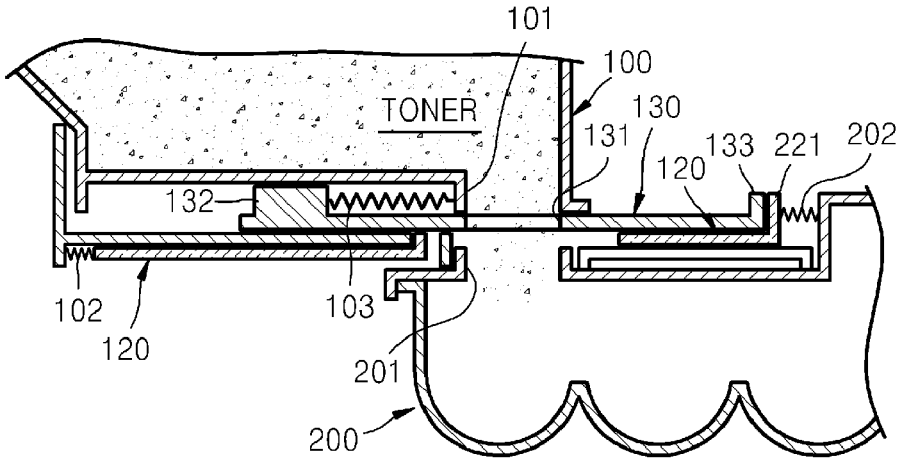
FIG. 4 is a cross-sectional view illustrating a state where the outer shutter and the inner shutter of the toner cartridge of FIG. 2 are opened.

FIG. 2 is a cross-sectional view of the toner cartridge 100 including an inner shutter 130 and an outer shutter 120, according to an embodiment of the present invention. FIG. 3 is a cross-sectional view illustrating a state where the outer shutter 120 of the toner cartridge 100 of FIG. 2 is opened. FIG. 4 is a cross-sectional view illustrating a state where the outer shutter 120 and the inner shutter 130 of the toner cartridge 100 of FIG. 2 are opened. Referring to FIGS. 2 through 4, the toner cartridge 100 includes the inner shutter 130 and the outer shutter 120. The inner shutter 130 has an opening 131. The outer shutter 120 is capable of moving to a first position (see FIG. 2) in which the toner is not allowed to be discharged through the opening 131, and a second position (see FIG. 3) in which the toner is allowed to be discharged through the opening 131. The inner shutter 130 is capable of moving to an open position (see FIG. 4) in which the opening 131 is in communication with a toner outlet 101, and a closed position (see FIG. 2) in which the toner outlet 101 is closed. The outer shutter 120 is disposed outside the inner shutter 130. As illustrated in FIG. 4, the toner outlet 101 is completely opened only when the outer shutter 120 is located at the second position and the inner shutter 130 is located at the open position. A first elastic member 102 applies an elastic force to the outer shutter 120 in a direction in which the outer shutter 120 is located at the first position. A second elastic member 103 applies an elastic force to the inner shutter 130 in a direction in which the inner shutter 130 is located at the closed position. For example, the first and second elastic members 102 and 103 may be compression coil springs. Unless a force is applied to the outer shutter 120 and the inner shutter 130 in a direction opposite to the direction of the elastic force of the first and second elastic members 102 and 103, the outer shutter 120 and the inner shutter 130 are maintained in the first position and the closed position, respectively. Accordingly, before the toner cartridge 100 is loaded into the main body 600, the inner shutter 130 and the outer shutter 120 are maintained in the closed position and the first position, respectively.

The outer shutter 120 is located at the second position or the first position according to whether the toner cartridge 100 is attached to or detached from the main body 600. The outer shutter 120 is maintained in the first position when the toner cartridge 100 is detached from the main body 600, and is moved to the second position when the toner cartridge 100 is loaded into the main body 600.

The toner cartridge 100 includes a housing 100*a* and a portion (or bottom side) 100*b*1 formed on a side (or bottom) of the housing 100*a* to define the toner outlet 101. The portion 100*b*1 may have a length longer than a width of the toner outlet 101 in a lengthwise direction or a movement direction of the inner shutter 130 or the outer shutter 120. The lengthwise direction or the movement direction may be a direction X. The inner shutter 130 and the outer shutter 120 may be arranged in a direction Y.

The toner cartridge 100 may further include a plate 100*p* disposed between the inner shutter 130 and the outer shutter 120 to support or guide the inner shutter 130 and the outer shutter 120 in the movement direction to provide a passage of the toner through the toner outlet 101. The portion 100*b*1 and/or the plate 100*p* may be disposed to cover the opening 131 of the inner shutter 130. The plate 100*p* may not be included in the toner cartridge 100, and the inner shutter 130 and the outer shutter 120 may be disposed adjacent to each other without support of the plate 100*p* with respect to the housing 100*a*.

When the outer shutter 120 is disposed in the first position, the outer shutter 120 does not allow the inner shutter 130 to be exposed to an outside of the housing 100*a*, and the outer shutter 120 covers the inner shutter 130. When the outer shutter 120 is disposed in the second position, the outer shutter 120 does not prevent the inner shutter 130 from being exposed to the outside, and the outer shutter 120 uncover the inner shutter 130. When the inner shutter 130 moves to the opening position, the opening 131 of the inner shutter 130 can be disposed to discharge the toner passing through the toner outlet 101 since outer shutter 120 does not block the passage of the discharged toner.

Figure 5:
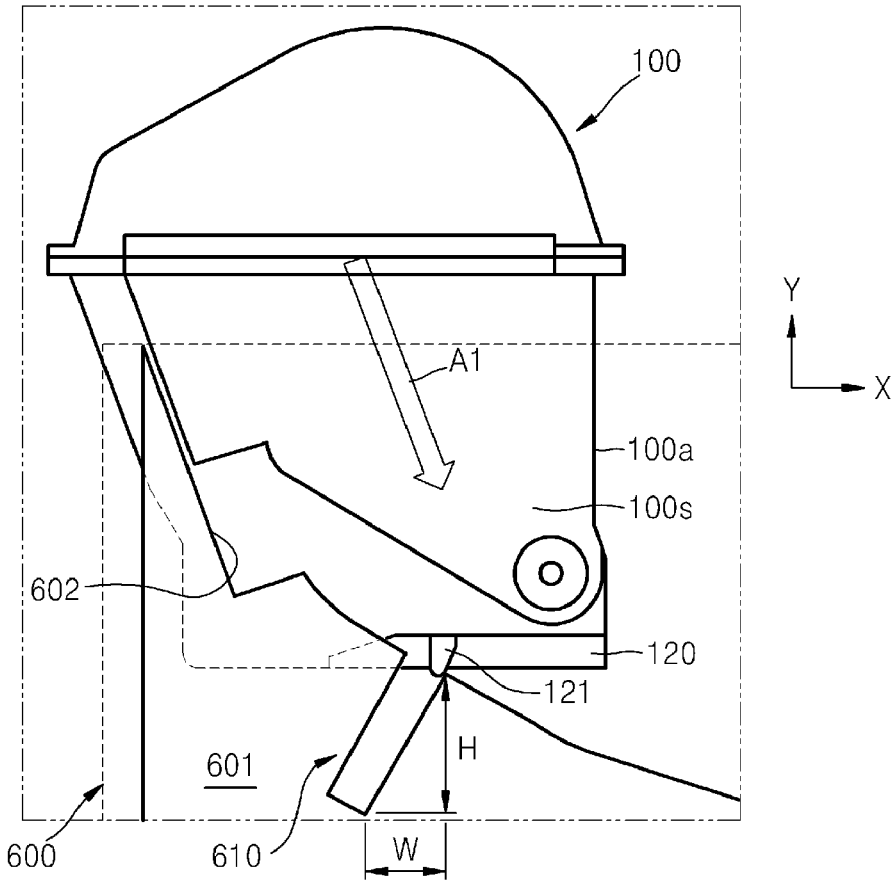
FIGS. 5 and 6 illustrate that the outer shutter is opened when the toner cartridge is loaded into a main body of an image forming apparatus.
Figure 6:
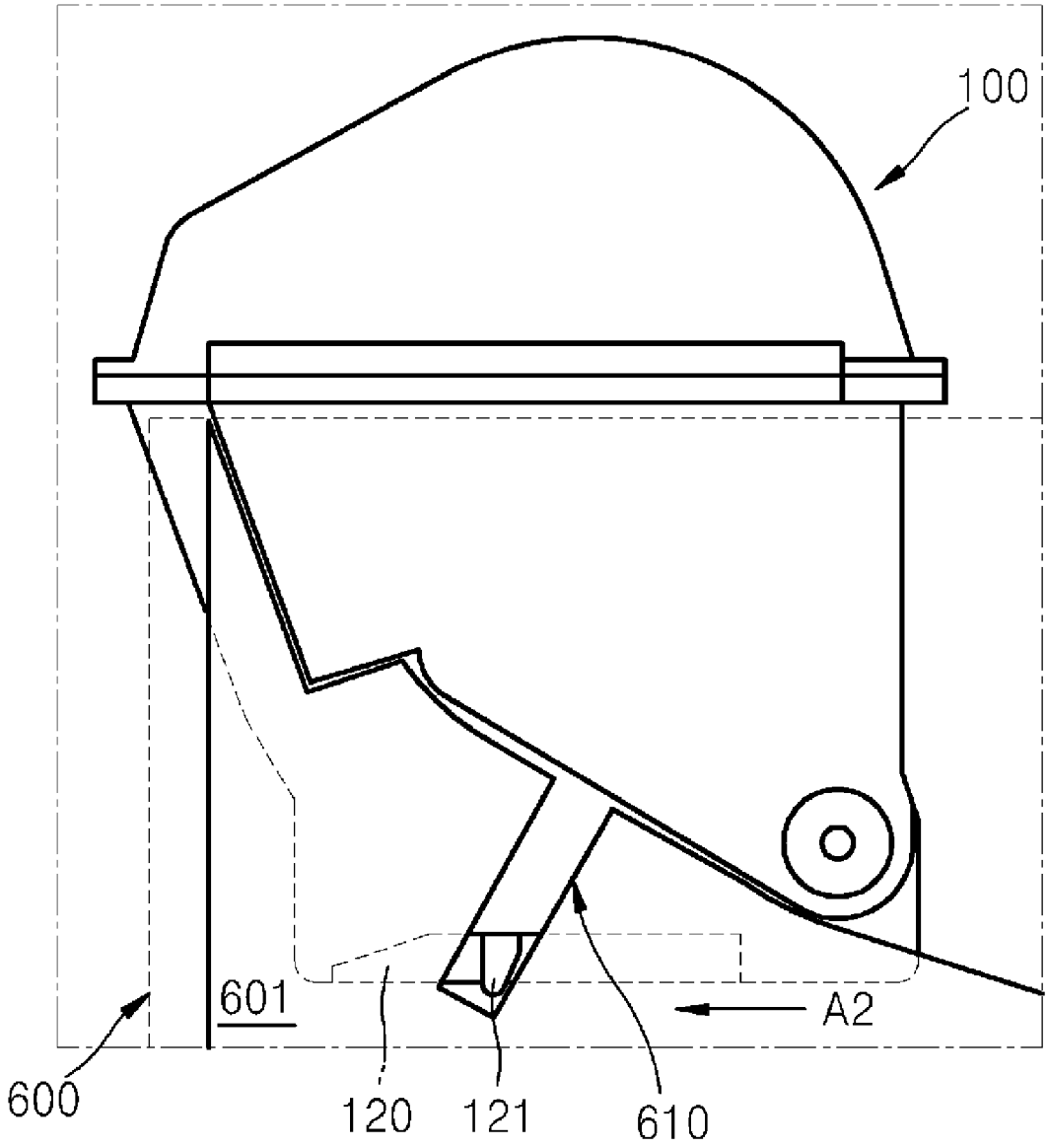

FIGS. 5 and 6 illustrate a state where the outer shutter 120 is opened when the toner cartridge 100 is loaded into the main body 600. Referring to FIG. 5, a guide portion 610 may be disposed in the main body 600 in order to move the outer shutter 120 to the second position. A guide projection 121 projects from a side portion of the outer shutter 120. The guide portion 610 may be a groove into which the guide projection 121 of the outer shutter 120 is inserted when the toner cartridge 100 is loaded into the main body 600. The guide portion 610 is inclined with respect to a direction A1 in which the toner cartridge 100 is loaded. The guide portion 610 may be formed in a sidewall 601 of the main body 600. When the toner cartridge 100 is loaded into the main body 600, the toner cartridge 100 is guided by a guide rail 602 disposed on the main body 600. When the toner cartridge 100 is inserted into the main body 600 to some extent, the guide projection 121 is inserted into the guide portion 610. In this state, when the toner cartridge 100 is moved in the direction A1, since the guide portion 610 is inclined in a direction opposite to the direction A1, the outer shutter 120 moves in a direction A2 (see FIG. 6). Accordingly, the outer shutter 120 begins to move to the second position from the first position.

When the toner cartridge 100 is completely loaded into the main body 600 as illustrated in FIG. 6, the outer shutter 120 is located at the second position as illustrated in FIG. 3. In order to detach the toner cartridge 100 from the main body 600, the toner cartridge 100 is lifted in a direction opposite to the direction A1. When the toner cartridge 100 is detached from the main body 600, the outer shutter 120 is guided by the guide portion 610 and returns to the first position (see FIG. 2) due to the elastic force of the first elastic member 102.

The guide portion 610 may be formed or disposed in a direction having an angle with a direction X or Y. When the toner cartridge 100 is inserted into an inside of the main body 600 through the door 700 and then installed on the processing unit 200 in the direction A1 having an angle with the direction X or Y. The direction of the guide portion 610 may be opposite to the direction A1 with respect to a line corresponding to the direction Y.

The guide portion 610 may have a length corresponding to a width W and a height L. The width W of the guide portion 610 can be determined according to a movement length of the outer shutter 120 between the first position and the second position. The height H of the guide portion 610 may be determined according to a user preference or a relative location of the processing unit 200 with respect to the main body 600 or the door 700. If an installation space is short, a traveling distance of the toner cartridge 100 becomes short, and accordingly the height H can be adjusted to correspond to the short installation space or the traveling distance.

Referring back to FIG. 3, the process cartridge 200 includes an inlet shutter 220 for opening and closing the toner inlet 201. A third elastic member 202 applies an elastic force to the inlet shutter 220 in a direction in which the toner inlet 201 is closed. For example, the third elastic member 202 may be a compression coil spring. In order to prevent the toner from leaking, the inlet shutter 220 is maintained in a position in which the toner inlet 201 is closed due to the elastic force of the third elastic member 202 when the process cartridge 200 is detached from the main body 600. Also, unless the toner cartridge 100 is loaded into the main body 600 even after the process cartridge 200 is loaded into the main body 600, the inlet shutter 220 is maintained in the position in which the toner inlet 201 is closed.

Since the inner shutter 130 is in the closed position while the toner cartridge 100 is loaded into the main body 600, the toner outlet 101 is maintained closed. Accordingly, the toner can be prevented from leaking through the toner outlet 101 and contaminating the inside of the electrophotographic image forming apparatus when the toner cartridge 100 is loaded into the main body 600.

The processing unit 200 may include a housing 200*a* and a plate 200*p* formed on the housing 200*a* to support or guide the inlet shutter to move between the above described positions. When the toner cartridge 100 is installed inside of the main body 600 of the image forming apparatus, the outer shutter 120 moves to the second position, and the inner shutter 130 and the inlet shutter 220 are disposed in a direction from the toner outlet 101 to the toner inlet 201, i.e., the direction Y, according to a guidance (combination) of the guide projection 121 and the guide portion 610. And then according to a movement of the door 7, the inner shutter 130 moves together with the inlet shutter 220 to provide a passage between the toner outlet 101 and the toner inlet 201.

As illustrated in FIGS. 6 and 3, when the toner cartridge 100 is completely loaded into the main body 600, since the outer shutter 120 is located at the second position, the inner shutter 130 is maintained in the closed position, and the inlet shutter 220 is located at the position in which the toner inlet 201 is closed, the toner outlet 101 and the toner inlet 201 are not in communication with each other. After the toner cartridge 100 is completely loaded into the main body, a user closes the door 700 of FIG. 1. Since the inner shutter 130 is interlocked in a closing operation of the door 700, the inner shutter 130 moves to the open position from the closed position when the door 700 is closed. In general, in order to attach and detach the toner cartridge 100 to and from the main body 600 of the electrophotographic image forming apparatus, the door 700 is opened and closed. In the electrophotographic image forming apparatus according to the present embodiment, the inner shutter 130 moves to the open position when the door 700 is closed. Also, as shown in FIG. 4, since a push arm 133 disposed on the inner shutter 130 is in contact with an arm 221 of the inlet shutter 220, the inlet shutter 220 is pushed by the inner shutter 130 when the inner shutter 130 moves to the open position, so that the inlet shutter 220 moves to a position in which the toner inlet 201 is opened. Accordingly, since the toner outlet 101 and the toner inlet 201 can be opened only by closing the door 700 to move the inner shutter 130 and the inlet shutter 220, a user does not need to perform an additional operation in order to open the toner outlet 101 and the toner inlet 201.

Figure 7:
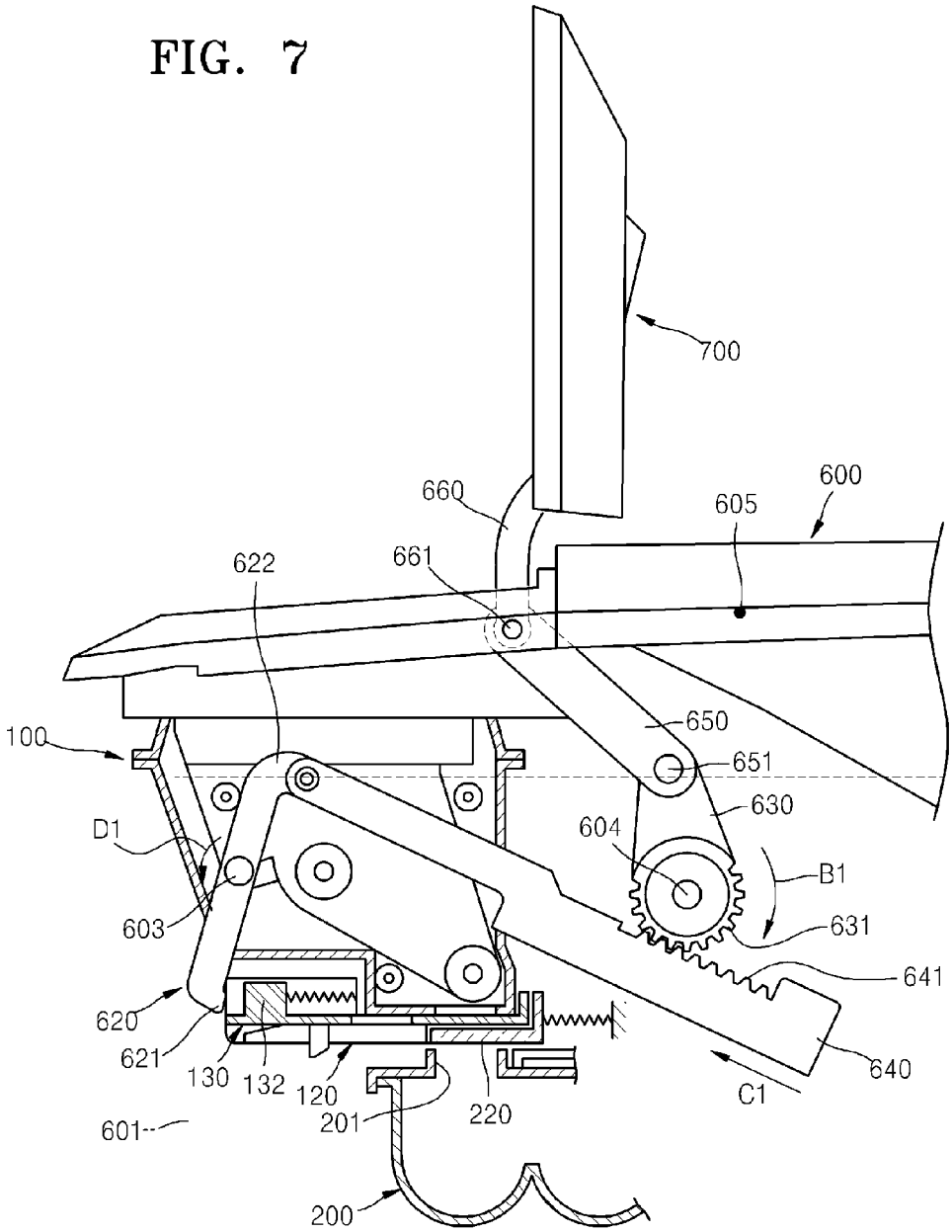
FIGS. 7 and 8 illustrate that the inner shutter is opened by closing a door after the toner cartridge is loaded into the main body.
Figure 8:
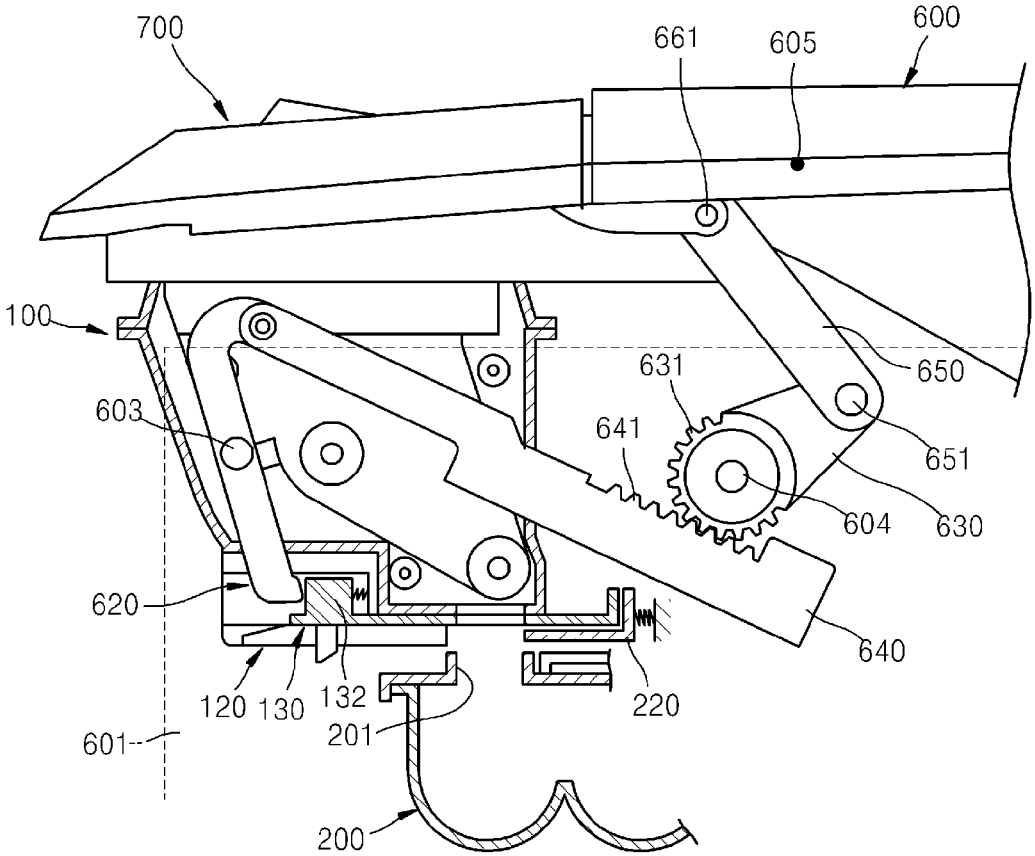

FIGS. 7 and 8 illustrate a state where the inner shutter 130 is opened by closing the door 700 after the toner cartridge 100 is loaded into the main body 600. Referring to FIG. 7, a pivot arm 620 pivots about a shaft 603 that is disposed on the sidewall 601 of the main body 600. A projection 132 projects from a side portion of the inner shutter 130. A first end 621 of the pivot arm 620 pushes the projection 132 by pivoting in a direction D1 about the shaft 603 when the door 700 is closed. Accordingly, the inner shutter 130 moves to the open position as shown in FIG. 4 and the inner shutter 130 pushes the inlet shutter 220 to open the toner inlet 201, so that the toner outlet 101 is in communication with the toner inlet 201 through the opening 131 of the inner shutter 130, and the toner is supplied from the toner cartridge 100 to the process cartridge 200.

In order to pivot the pivot arm 620 in the opening and closing operation of the door 700, a pinion 631 that is connected to the door 700 and rotates in the opening and closing operation of the door 700, and a rack 641 that is connected to the pinion 631 and slides may be employed. The rack 641 is disposed on a slider 640 that is slidably supported on the sidewall 601 of the main body 600. A second end 622 of the pivot arm 620 is connected to the slider 640. The pinion 631 is disposed on a first link 630 that pivots about a central shaft 604 disposed on the sidewall 601 of the main body 600. The central shaft 604 is a rotational shaft of the pinion 631. The first link 630 is connected to a second link 650. The second link 650 is connected to a third link 660 that extends from the door 700. The first and second links 630 and 650 are connected to each other by a first connecting portion 651 that is pivotable. The second and third links 650 and 660 are connected to each other by a second connecting portion 661 that is pivotable. The first and second connecting portions 651 and 661 are not restricted by the sidewall 601 of the main body 600. The door 700 is connected to the main body 600 so as to pivot about a pivot shaft 605 via an arm (not illustrated).

When the door 700 pivots from an open position to a closed position, the second and third links 650 and 660 push the first link 630 to rotate the first link 630 about the central shaft 604 in a direction B1. Since the pinion 631 and the rack 641 are connected to each other, the slider 640 slides in a direction C1. The pivot arm 620 pivots about the shaft 603 in the direction D1, and the first end 621 of the pivot arm 620 pushes the projection 132 of the inner shutter 130 to move the inner shutter 130 to the open position as shown in FIG. 8. At this time, the inlet shutter 220 of the process cartridge 200 is pushed by the inner shutter 130 to move along with the inner shutter 130. When the door 700 is completely closed, as shown in FIGS. 8 and 4, the inner shutter 130 is located at the open position and the opening 131 communicates with the toner outlet 101. The toner inlet 201 of the process cartridge 200 is also opened, so that the toner inlet 201 is in communication with the toner outlet 101 through the opening 131. Accordingly, the toner is supplied from the toner cartridge 100 to the process cartridge 200.

When the door 700 is opened in order to detach the toner cartridge 100 from the main body 600, the slider 640 and the pivot arm 620 return to the their original positions as shown in FIG. 7 due to the rotation of the pinion 631, and the inner shutter 130 moves to the closed position due to the elastic force of the second elastic member 103. The inlet shutter 220 moves due to the elastic force of the third elastic member 202 to the position in which the toner inlet 201 is closed, and the inner shutter 130 is returned to the closed position. The toner cartridge 100 is detached from the main body 600. At this time, since the toner outlet 101 is closed due to the inner shutter 130, the toner (or a remaining toner) does not leak. As the toner cartridge 100 is detached from the main body 600, a force applied to the outer shutter 120 is removed, and then the outer shutter 120 returns to the first position due to the elastic force of the first elastic member 102.

Although the inner shutter 130 is located at the closed position and the open position by using the pinion 631, the rank 641, and the first through third links 630, 650, and 660 in FIGS. 7 and 8, the present invention is not limited thereto. It is possible that the opening and closing operation of the door 700 may be interlocked with the opening and closing operation of the inner shutter 130 in various other ways.

Although the plate 100*p* of FIG. 2 is not illustrated in FIGS. 7 and 8, it is possible that the plate 100*p* can be disposed between the inner shutter 130 and the outer shutter 120 as illustrated in FIGS. 2 and 3. According to an embodiment of the FIGS. 7 and 8, the outer shutter 120 and the inner shutter 130 may have strength to maintain their original shape and also maintain the first and second positions and the closing and opening positions, respectively. It is possible that the outer shutter 120 and the inner shutter 130 are disposed to contact each other to relative move in the opening direction and the closing direction. It is also possible that the inner shutter 130 and the inner shutter can be guided or supported by structures of the housing 100*a*.

Figure 9:
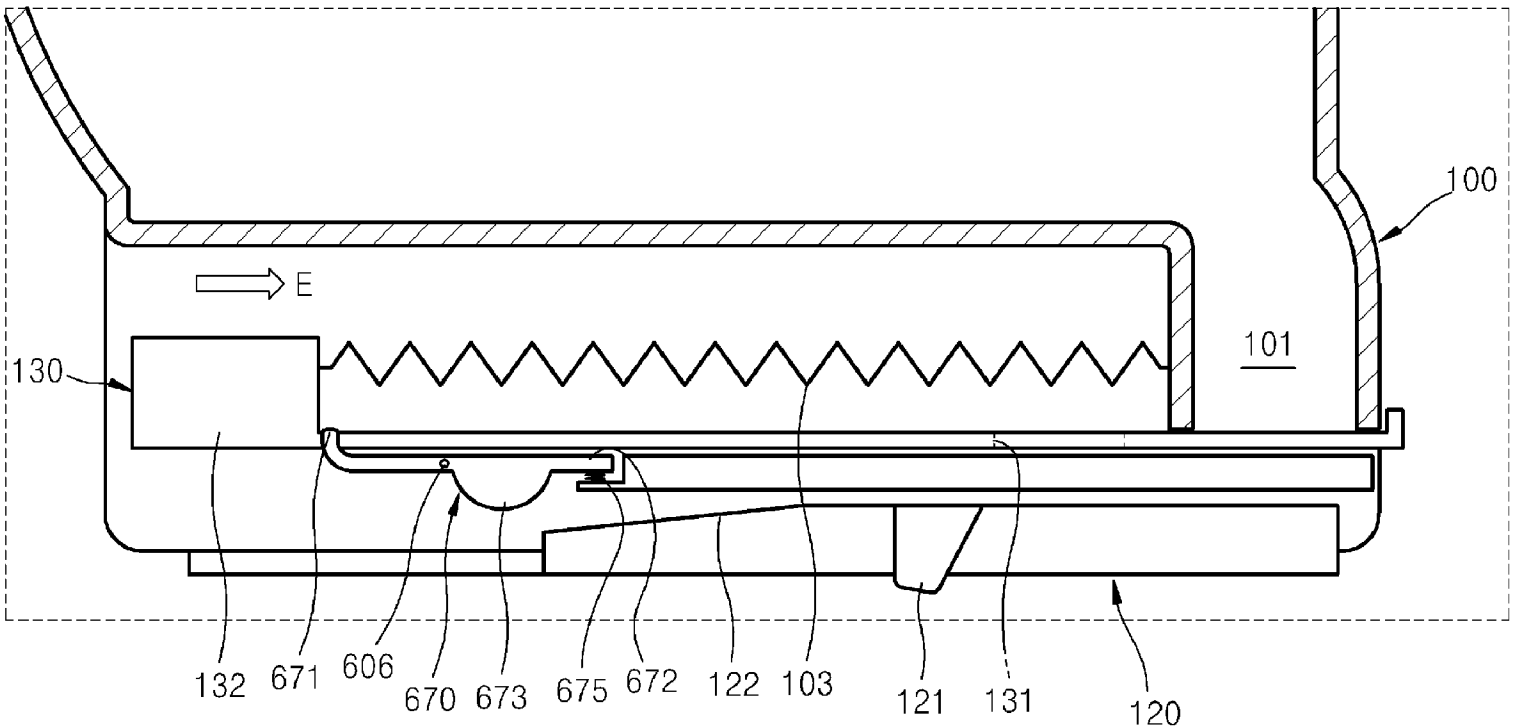
FIG. 9 illustrates a state where the inner shutter is locked.
Figure 10:
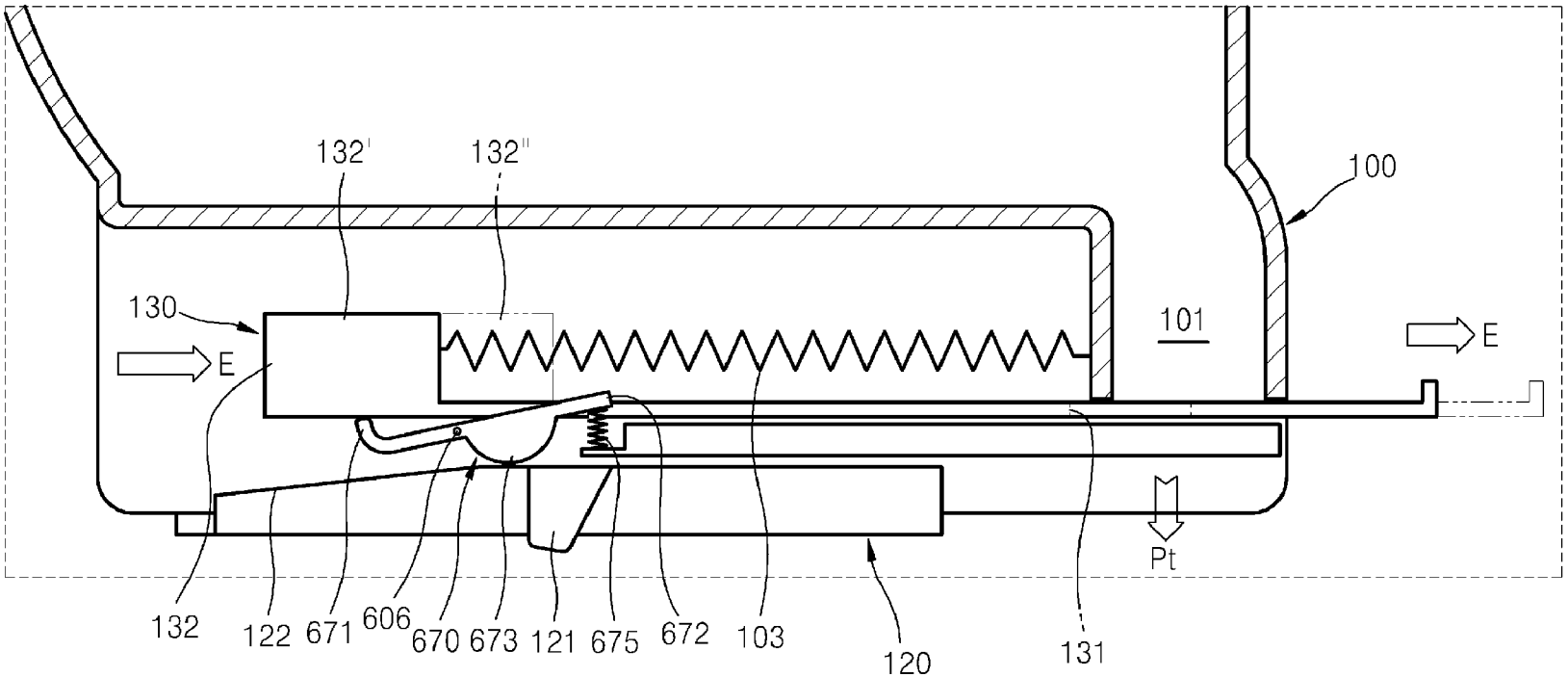
FIG. 10 illustrates a state where the inner shutter is unlocked.

FIG. 9 illustrates a state where the inner shutter 130 is locked. FIG. 10 illustrates a state where the inner shutter 130 is unlocked. In FIG. 9, a locking member 670 selectively allows the inner shutter 130 to move to the open position from the closed position. The locking member 670 may have a locking position in which the inner shutter 130 is locked to the closed position when the outer shutter 120 is located at the first position as shown in FIG. 2, and an unlocking position in which the inner shutter 130 is allowed to move to the open position when the outer shutter 120 is located at the second position. For example, the locking member 670 may be installed on the toner cartridge 100 so as to pivot about a pivot shaft 606 to the locking position and the unlocking position. A fourth elastic member 675 applies an elastic force to the locking member 670 in a direction in which the locking member 670 pivots to the locking position. For example, the fourth elastic member 675 may be an extension coil spring. The locking member 670 may interfere with the outer shutter 120 and move to the unlocking position as the outer shutter 120 moves from the first position to the second position.

Referring to FIG. 9, a first end 671 of the locking member 670 at the locking position is in contact with the projection 132 of the inner shutter 130 that is located at the closed position. A first end of the fourth elastic member 675 is connected to a second end 672 of the locking member 670, and also connected to a side portion of the toner cartridge 100. In this state, the inner shutter 130 does not move since the inner shutter 130 is locked by the locking member 670 even though the projection 132 is pushed in a direction E in order to move the inner shutter 130 to the open position.

An interference portion 673 protruding toward the outer shutter 120 is disposed between the pivot shaft 606 and the second end 672 of the locking member 670. When the outer shutter 120 moves to the second position as shown in FIGS. 5 and 6, a side surface 122 of the outer shutter 120 pushes the interference portion 673, and the locking member 670 pivots in a direction opposite to the direction of the elastic force of the fourth elastic member 675. Then, the first end 671 of the locking member 670 pivots to the unlocking position escaping from the projection 132 of the inner shutter 130 as shown in FIG. 10. In this state, the inner shutter 130 moves to the open position. Since the outer shutter 120 moves to the second position when the toner cartridge 100 is loaded into the main body 600, the locking member 670 is located at the unlocking position. When the door 700 is closed in this state, as shown in FIGS. 7 and 8, the pivot arm 620 pivots in the direction D1 to push the projection 132 in the direction E, thereby allowing the inner shutter 130 to move to the open position.

In the state where the toner cartridge 100 is separated from the main body 600, the inner shutter 130 and the outer shutter 120 are located at the closed position and the first position, respectively. When the inner shutter 130 moves to the open position, the opening 131 and the toner outlet 101 are in communication with each other and thus the toner flows out through the opening 131. However, since the toner is blocked by the outer shutter 120 that is located at the first position, the toner is prevented from leaking to the outside of the toner cartridge 100. Even when the inner shutter 130 moves again to the closed position due to the elastic force of the second elastic member 103 to block the toner outlet 101, the toner flowing out through the opening 131 exists between the outer shutter 120 and the inner shutter 130. When the toner cartridge 100 is loaded into the main body 600, the outer shutter 120 moves to the second position as shown in FIGS. 5 and 6. At this time, the toner existing between the outer shutter 120 and the inner shutter 130 may leak and contaminate the inside of the main body 600. According to the toner cartridge 100 illustrated in FIGS. 9 and 10, however, the inner shutter 130 is locked by the locking member 670 when the outer shutter 120 is located at the first position, thereby preventing the toner from leaking. Furthermore, since the inner shutter 130 is unlocked due to the movement of the outer shutter 120 to the second position when the toner cartridge 100 is loaded into the main body 600, an additional operation for unlocking the inner shutter 130 is not necessary.

As illustrated in FIG. 10, the projection 132 moves in the direction E to a position corresponding to a projection 132' and another position 132" as indicated with broken lines, such that the toner can pass through a path Pt formed with the toner outlet 101, the opening 131, and the toner inlet 201.

While the present invention has been particularly shown and described with reference to exemplary embodiments thereof, it will be understood by one of ordinary skill in the art that various changes in form and details may be made therein without departing from the spirit and scope of the present general inventive concept as defined by the following claims.

Although a few embodiments of the present invention have been shown and described, it would be appreciated by those skilled in the art that changes may be made in these embodiments without departing from the principles and spirit of the general inventive concept, the scope of which is defined in the claims and their equivalents

What is claimed is:

1. An image forming apparatus comprising:

a main body that comprises a door capable of opening and closing;

a process cartridge that is loaded into the main body and comprises a toner inlet, the process cartridge having an inlet shutter disposed on the process cartridge to open and close the toner inlet, the inlet shutter operating together with an inner shutter of a toner cartridge; and the toner cartridge that contains toner to be supplied to the process cartridge, is attached to and detached from the main body through the door, and comprises a toner outlet connected to the toner inlet, the inner shutter having an opening and being capable of moving to an open position in which the opening is in communication with the toner outlet and a closed position in which the toner outlet is closed, and an outer shutter that is disposed outside the inner shutter and is capable of moving to a first position and a second position respectively not allowing and allowing the toner to be discharged through the opening, wherein the outer shutter moves to the second position when the toner cartridge is loaded into the main body, and the inner shutter moves from the closed position to the open position by being interlocked in a closing operation of the door after the toner cartridge is loaded into the main body.

2. The image forming apparatus of claim 1, further comprising:

a guide portion disposed in the main body to move the outer shutter to the second position by interfering with the outer shutter when the toner cartridge is loaded into the main body.

3. The image forming apparatus of claim 1, wherein the inner shutter moves the inlet shutter to a position in which the toner inlet is opened when the inner shutter moves to the open position.

4. The image forming apparatus of claim 3, further comprising:

a pivot arm that pivots in an opening and closing operation of the door to move the inner shutter to the open position.

5. The image forming apparatus of claim 4, further comprising:

a pinion that is connected to the door with a plurality of links and rotates in the opening and closing operation of the door; and a rack that pivots the pivot arm by being engaged with the pinion and slides.

6. The image forming apparatus of claim 3, further comprising:

first, second, and third elastic members to apply elastic forces to the outer shutter, the inner shutter, and the inlet shutter so that the outer shutter, the inner shutter, and the inlet shutter are located at the first position, the closed position, and a position in which the toner inlet is closed, respectively.

7. The image forming apparatus of claim 1, further comprising:

a locking member that moves to a locking position in which the inner shutter is locked to the closed position when the outer shutter is located at the first position, and an unlocking position in which the inner shutter is allowed to move when the outer shutter is located at the second position.

8. The image forming apparatus of claim 7, further comprising:

another elastic member to apply an elastic force to the locking member in a direction in which the locking member is located at the locking position, wherein when the outer shutter moves to the second position, the locking member interferes with the outer shutter so as to move to the unlocking position.

9. A toner cartridge to contain toner to be supplied to a process cartridge, the process cartridge having an inlet shutter disposed thereon to open and close a toner inlet, the inlet shutter operating together with an inner shutter of the toner cartridge and attached to and detached from a main body through a door that is disposed on the main body and capable of opening and closing, the toner cartridge comprising:

a toner outlet through which the toner is discharged;

the inner shutter that has an opening and is capable of moving to an open position in which the opening is in communication with the toner outlet and a closed position in which the toner outlet is closed;

an outer shutter that is disposed outside the inner shutter, and is capable of moving to a first position and a second position not allowing and allowing the toner to be discharged through the opening, respectively, wherein the outer shutter moves to the second position when the toner cartridge is loaded into the main body, and the inner shutter moves from the closed position to the open position by being interlocked in a closing operation of the door after the toner cartridge is loaded into the main body.

10. The toner cartridge of claim 9, further comprising:

first and second elastic members to apply elastic forces to the outer shutter and the inner shutter so that the outer shutter and the inner shutter are located at the first position and the closed position, respectively.

11. The toner cartridge of claim 9, further comprising:

a locking member that comprises a locking position in which the inner shutter is locked in the closed position when the outer shutter is located at the first position, and an unlocking position in which the inner shutter is allowed to move when the outer shutter is located at the second position.

12. The toner cartridge of claim 11, further comprising:

another elastic member to apply an elastic force to the locking member in a direction in which the locking member is located at the closed position, wherein when the outer shutter moves to the second position, the locking member interferes with the outer shutter so as to move to the unlocking position,

13. A toner cartridge usable with an image forming apparatus, comprising:

a housing to contain toner and having a toner outlet to discharge the toner;

an inner shutter disposed to move between an opening position to open the toner outlet and a closed position to close the toner outlet, the inner shutter including a plate and an opening formed therein; and an outer shutter disposed to move between a first position to prevent the inner shutter from being exposed to an outside of the housing and a second position to expose the inner shutter to the outside of the housing; and first and second elastic members to apply elastic forces to the outer shutter and the inner shutter so that the outer shutter and the inner shutter are located at the first position and the closed position, respectively, wherein the toner outlet communicates with the outside when the outer shutter is in the second position and then the inner shutter is in the opening position.

14. The toner cartridge of claim 13, wherein the plate moves to the opening position to dispose the opening to correspond to the toner outlet.

15. The toner cartridge of claim 14, wherein the plate of the inner shutter comprises a non-opening portion to define the opening, and the non-opening portion is disposed in the toner outlet in the closing position of the inner shutter.

16. The toner cartridge of claim 13, wherein the inner shutter protrudes from the housing in the opening position.

17. The toner cartridge of claim 13, wherein the inner shutter moves from the closed position to the opening position in a direction when the outer shutter moves from the first position to the second position in another direction opposite to the direction.

18. The toner cartridge of claim 13, further comprising:

a guide plate disposed between the inner shutter and the outer shutter to guide the inner shutter and the outer shutter with respect to the housing.

19. The toner cartridge of claim 13, wherein the inner shutter and the outer shutter are disposed in a direction, and the inner shutter and the outer shutter have different lengths in the direction.

20. The toner cartridge of claim 14, wherein the opening of the inner shutter is not exposed to the toner when the inner shutter is disposed in the closing position.

21. An image forming apparatus comprising:

a main body having a door and a guide portion;

a processing unit disposed in the main body, and having a toner inlet and an inlet shutter disposed to open and close the toner inlet, the inlet shutter operating together with an inner shutter of a toner cartridge; and the toner cartridge to be installed in the main body through the door, and comprising:

a housing to contain toner and having a toner outlet to discharge the toner;

the inner shutter disposed to move between an opening position to open the toner outlet and a closed position to close the toner outlet, according to a movement of the door; and an outer shutter disposed to move between a first position to prevent the inner shutter from being exposed to an outside of the housing and a second position to expose the inner shutter to the outside of the housing, according to a guiding operation of the guide portion, wherein the toner outlet communicates with the outside when the outer shutter is in the second position and then the inner shutter is in the opening position.

22. The image forming apparatus of claim 21, wherein the toner inlet moves to open the toner inlet to communicate with the toner outlet of the toner cartridge according to a movement of the inner shutter.

23. The image forming apparatus of claim 22, wherein the inlet shutter of the processing unit is disposed at a portion where the outer shutter has been disposed in the first position.

24. The image forming apparatus of claim 22, wherein the inlet shutter of the processing unit prevents the inner shutter of the toner cartridge from being exposed to the outside when the outer shutter is disposed in the second position to expose the inner shutter.

25. The image forming apparatus of claim 22, wherein the outer shutter of the toner cartridge is disposed at a location in the first position, and the inlet shutter of the inlet shutter of the processing unit is disposed at the location to close the toner inlet.

26. The image forming apparatus of claim 22, wherein the inner shutter, the outer shutter, and the inlet shutter have different lengths in a direction of a movement of one of the inner shutter, the outer shutter, and the inlet shutter.

27. The image forming apparatus of claim 21, wherein the inner shutter and the outer shutter have different lengths in a direction of a movement of one of the inner shutter and the outer shutter.

* * * * *